US006537039B2

(12) United States Patent
Mann

(10) Patent No.: US 6,537,039 B2
(45) Date of Patent: Mar. 25, 2003

(54) HYDRAULIC DRIVE PORTABLE AIR COMPRESSOR SYSTEM

(76) Inventor: Ken Mann, Box 158, Dinsmore, Saskatchewan (CA), S0L 0T0

( * ) Notice: Subject to any disclaimer, the term of this patent is extended or adjusted under 35 U.S.C. 154(b) by 0 days.

(21) Appl. No.: 09/735,857

(22) Filed: Dec. 13, 2000

(65) Prior Publication Data

US 2001/0005481 A1 Jun. 28, 2001

(30) Foreign Application Priority Data

Dec. 13, 1999 (CA) ..... 2292344

(51) Int. Cl.[7] ..... F04B 53/00

(52) U.S. Cl. ..... 417/234; 417/375; 137/565.18; 91/432; 180/53.1

(58) Field of Search ..... 417/234, 307, 417/375, 440; 137/565.18, 899.4; 91/432, 446, 468; 180/53.1, 53.4

(56) References Cited

U.S. PATENT DOCUMENTS 1,582,028 A * 4/1926 Dunn
1,817,698 A * 8/1931 McMillan
1,889,451 A * 11/1932 Ne Page
2,241,192 A * 5/1941 Freeman ..... 230/30
2,804,259 A * 8/1957 Ralston ..... 230/58
2,826,354 A * 3/1958 Field ..... 230/33
2,991,925 A * 7/1961 Browne ..... 230/38
4,211,254 A * 7/1980 Dyal ..... 91/446
4,270,885 A * 6/1981 Shaffer et al. ..... 417/279
4,462,566 A * 7/1984 French ..... 91/446
5,054,740 A * 10/1991 Wheeler ..... 248/675
5,399,072 A 3/1995 Westphal
6,065,942 A * 5/2000 Glidden et al. ..... 417/234
6,126,402 A * 10/2000 Fisher et al. ..... 417/294
6,186,198 B1 * 2/2001 Holmes ..... 180/53.4

OTHER PUBLICATIONS

Ace Hose & Rubber Co., 1996, Ace Hose & Rubber Co., Fittings & Couplings, 3 pages.*
Ace Hose & Rubber Co., 1996, Ace Hose & Rubber Co., Hydraulic Hose & Fittings, 5 pages.*
White Hydraulics Inc., 1992, White Hydraulics Inc., DT Series Hydraulic Motor, 13 pages.*
Stanley Works, 1998, Stanley Works, New Stacked Air Compressor from Stanley, 2 pages.*
Bernie's Atomotive Products, 2001, Bernie's Automotive Products, Welcome to Bernie's Automotive Products, 8 pages.*

* cited by examiner

*Primary Examiner*—Charles G. Freay
*Assistant Examiner*—John F Belena
(74) *Attorney, Agent, or Firm*—Patterson, Thuente, Skaar & Christensen, P.A.

(57) ABSTRACT

A portable high capacity air compressor system comprises an air compressor with a hydraulic motor coupled thereto to form a compact compressor unit, and a removable air reservoir which is releasably attached to the compressor unit.

4 Claims, 5 Drawing Sheets

HYDRAULIC DRIVE PORTABLE AIR COMPRESSOR SYSTEM

This invention is in the field of air compressors and in particular the field of high capacity portable air compressors.

BACKGROUND

It is a well known advantage to have compressed air available on a vehicle for refilling tires and so forth. Portable air compressors are well known which are powered by the electrical system of vehicles. An example of such a compressor is disclosed in U.S. Pat. No. 5,399,072 to Westphal. It is also well known to permanently mount air compressors on a vehicle where the compressor is driven by the vehicle engine through a belt or the like. Such compressors are used in trucks for operating air brakes and so forth, and are common on tire servicing trucks for servicing tires at remote locations. The known electrically powered portable compressors are limited in capacity by the limited electrical power available on vehicles. Where large volumes of high pressure air are required at remote locations, the permanently vehicle mounted compressor, or a gasoline engine operated portable compressor apparatus must be used. For effective operation, such portable compressor apparatuses include an air reservoir. In known portable air compressor apparatuses the air reservoir is permanently mounted to the apparatus, often with the motor and compressor attached thereto. As known high capacity portable air compressor apparatuses are too heavy to be easily carried by one person, a separate portable tank must be filled from the apparatus to conveniently carry compressed air to a separate site.

It is convenient to have such higher volumes and pressures available for effectively operating air tools such as wrenches, drills, chisels and so forth, as well as for blowing out radiators and the like. Such a high capacity air compressor would be advantageous in many situations. For example in agricultural operations it is common to remove and ground working tools, such as cultivator shovels, in the field, remote from the usual sources of compressed air. Flat tires are also common, requiring reinflation or installation of a spare. Air wrenches reduce the time required to complete such operations considerably compared to manually operated wrenches, and reduce effort and stress for the operator.

Generally a farm will have a number of tractors, combines and similar powered equipment and vehicles which are not generally all being used at the same time. While possible, mounting a high capacity air compressor permanently on each vehicle would be prohibitively expensive.

It would be beneficial to provide a high capacity portable air compressor apparatus that was capable of supplying a sufficient volume and pressure of compressed air to operate air tools effectively and that could conveniently be temporarily powered by, and/or mounted on a vehicle and that was easily moved from one such vehicle to another. Such an apparatus where the air reservoir could be removed for carrying air to a remote location would be further beneficial.

SUMMARY OF THE INVENTION

The majority of powered agricultural vehicles have a hydraulic power system which can readily provide enough power to drive a high capacity compressor unit, comprising an air compressor and hydraulic motor, that would supply sufficient volume and pressure to drive air tools. Many trucks as well have a suitable hydraulic power system. An air compressor with sufficient capacity to drive air tools would also supply sufficient air to blow out radiators and so forth as well. In order to provide satisfactory service the compressor unit must be connected to an air reservoir.

It is the object of the present invention to provide a portable apparatus that is driven by a vehicle hydraulic power system and that will supply compressed air at sufficient volume and pressure to drive air tools, and that includes an air reservoir that may be removed from the apparatus for carrying compressed air to a remote location.

The invention provides a portable high capacity air compressor system comprising an air compressor with a hydraulic motor coupled thereto to form a compact compressor unit, and a removable air reservoir which is releasably attached to the compressor unit.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
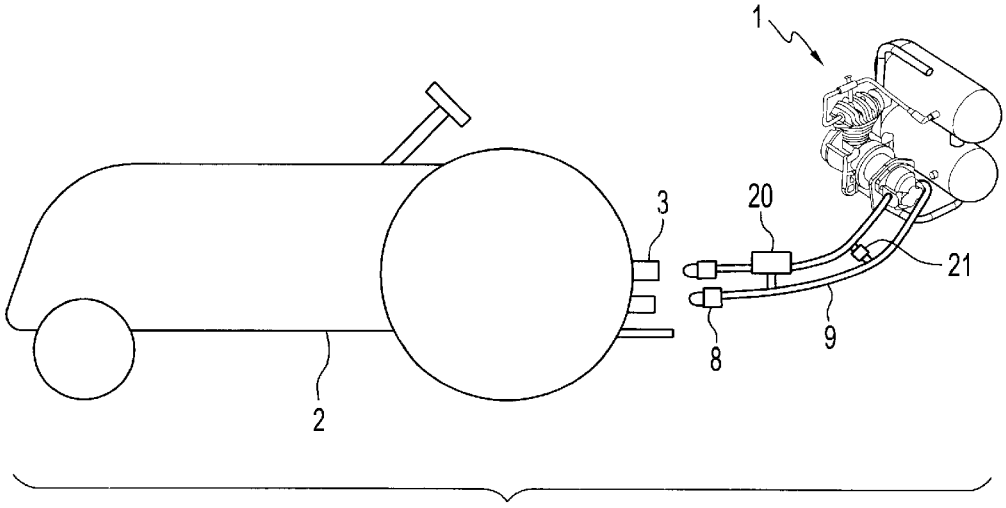
FIG. 1 is a perspective view of an embodiment in position for temporary connection to the hydraulic power system of a tractor.

FIG. 1 illustrates an embodiment of the portable hydraulic powered high capacity air compressor system 1 of the invention. The air compressor system 1 is designed for use with a vehicle, illustrated as a tractor 2, which includes a hydraulic power system connectable at hydraulic outlets 3 to a hydraulically operated device, such as the air compressor system 1.

Figure 3:
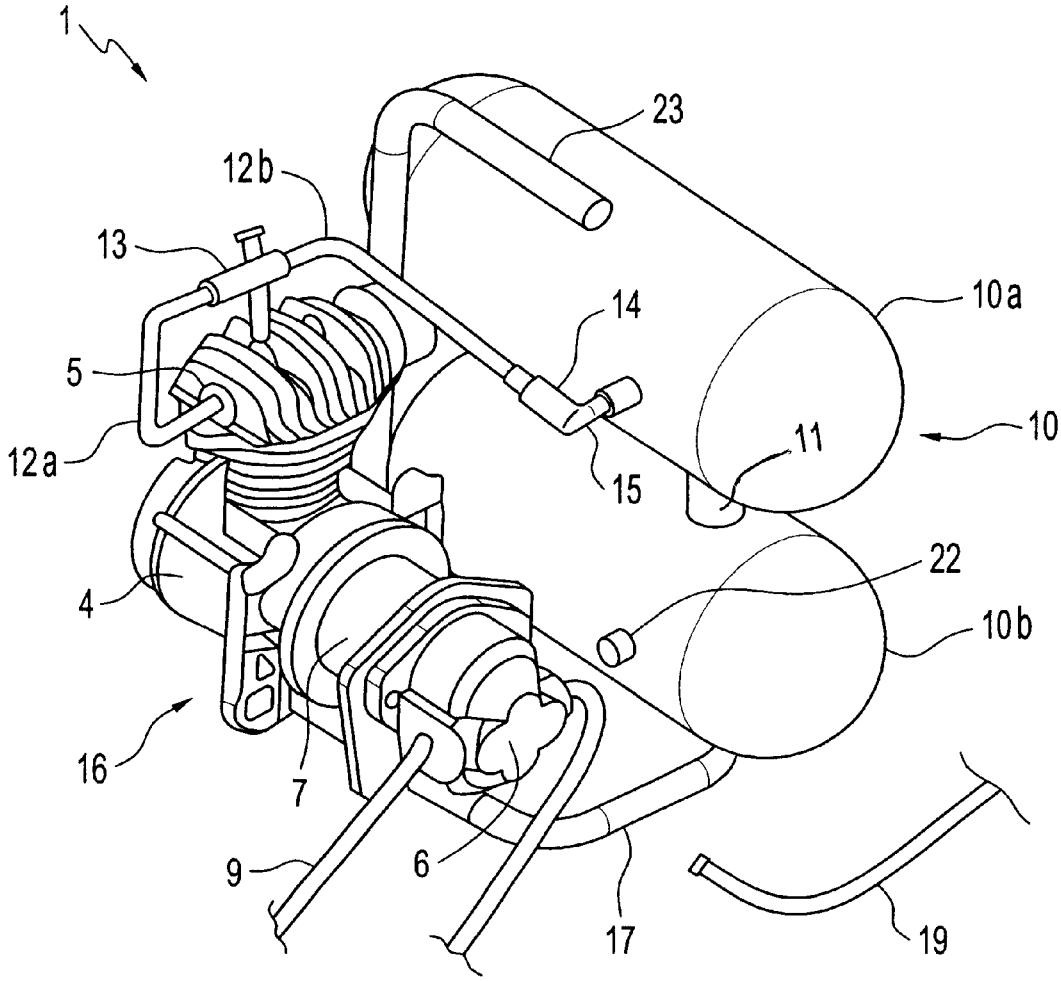
FIG. 3 is an enlarged perspective view of the embodiment of FIG. 1.
Figure 4:
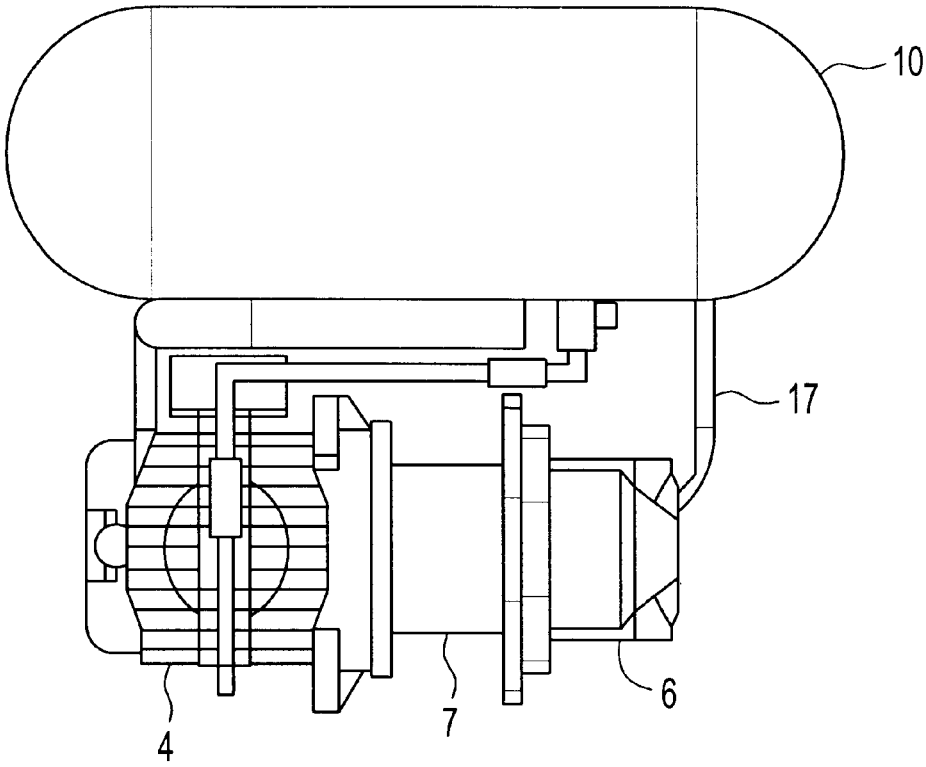
FIG. 4 is a top view of the air compressor unit and air reservoir attached to the frame in the embodiment of FIG. 1.
Figure 5:
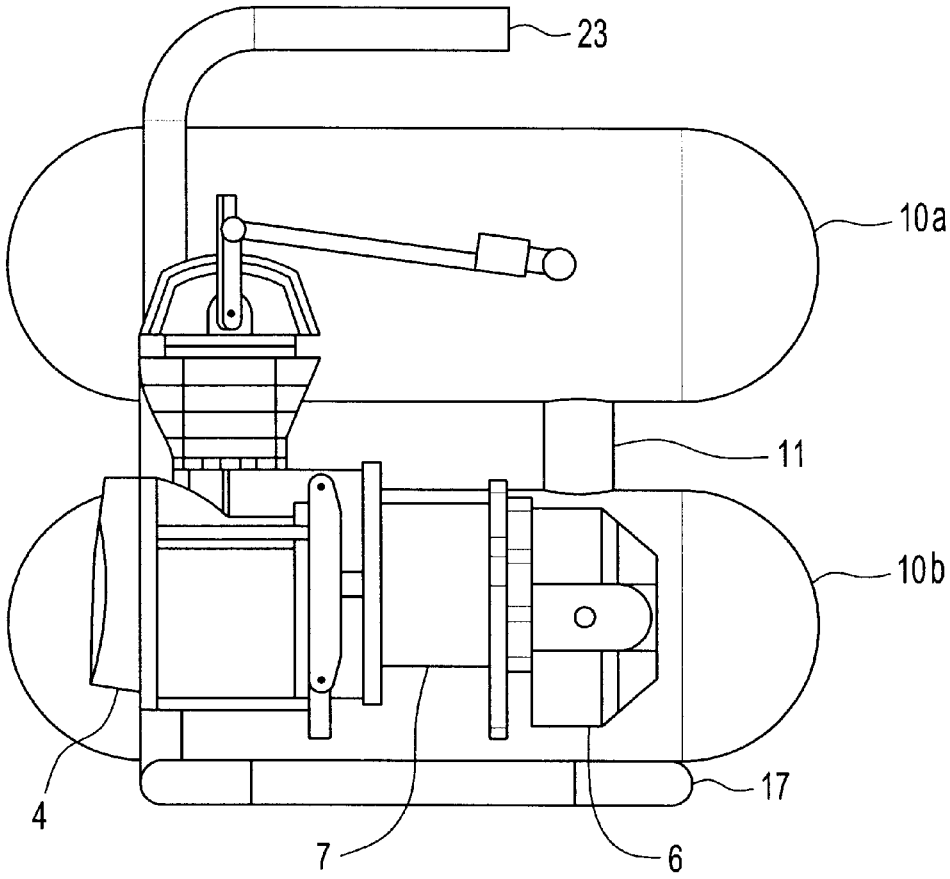
FIG. 5 is a front view of the air compressor unit and air reservoir attached to the frame as in FIG. 4.
Figure 6:
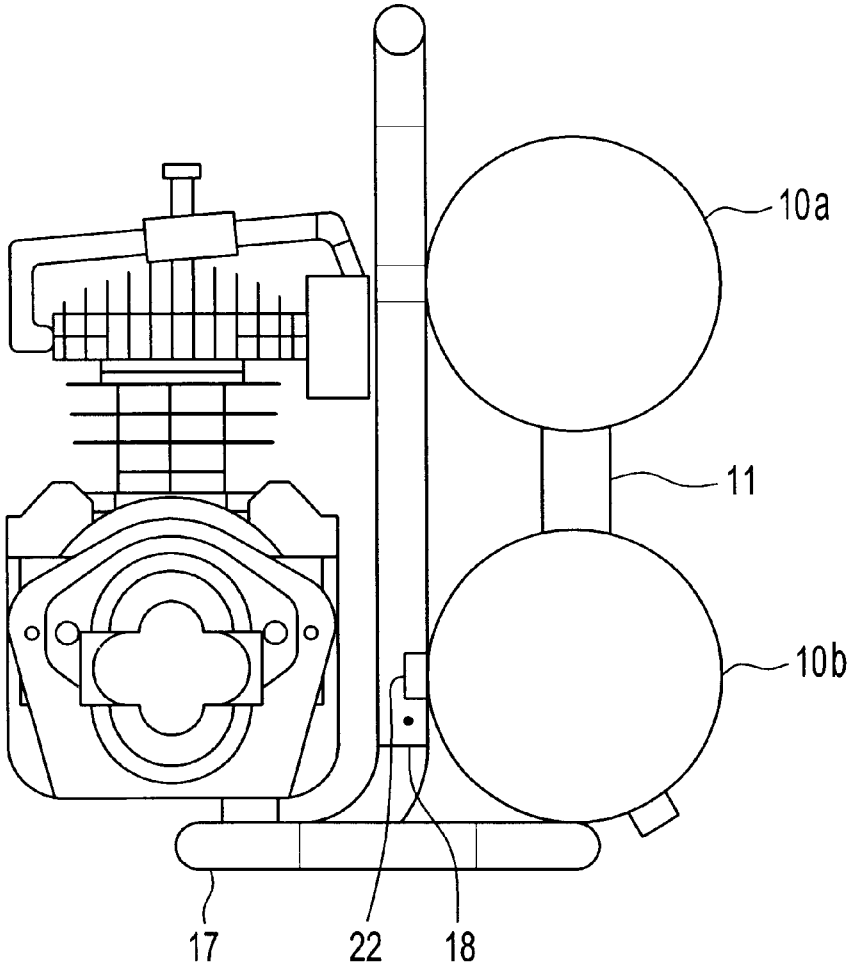
FIG. 6 is an end view of the air compressor unit and air reservoir attached to the frame as in FIG. 4.

As best seen in FIG. 3, the air compressor system 1 includes an air compressor 4 having a compressed air outlet 5 for dispensing compressed air. A hydraulic motor 6 is attached to the air compressor 4 and is operatively connected thereto for driving same. In the illustrated embodiment a spacer 7 is bolted between the air compressor 4 and hydraulic motor 6 to adapt the fittings on one to the other. The hydraulic motor 6 has a conventional shaft that passes through the spacer 7 for connection by a key-way or the like to drive the air compressor 4. The air compressor 4 and attached hydraulic motor 6 form a compressor unit 16, which is attached to a frame 17.

To drive the hydraulic motor 6, hydraulic quick couplers 8 on the free ends of hoses 9 are provided to allow the hydraulic motor 6 to be temporarily connected to the hydraulic power system of the tractor 2 at hydraulic outlets 3. Similar connection would be made to truck or other vehicle. Quick couplers can be provided on a vehicle where it is proposed to use the system and where same are not normally provided, such as a combine or the like.

A flow control valve 20 is connected between the hoses 9 to provide a substantially constant flow of hydraulic fluid to the hydraulic motor 6 from various hydraulic power systems on different vehicles, with varying outputs of flow and pressure. The hydraulic motor 6 will thus rotate at a substantially constant speed when used with different vehicles and the hydraulic power systems thereon, provided the hydraulic power system supplies at least a minimum pressure and flow. One-way valve 21 is also connected between the hoses 9 to allow the hydraulic motor 6 to free-wheel to a stop when the flow of oil from the hydraulic power system of the tractor 2 is cut off, as when the hydraulic power system control valve is closed.

An air reservoir 10 comprises two tanks 10*a* and 10*b* connected by a pipe 11. A single tank could be used as well, however the dual tanks provide a fairly compact reservoir that has sufficient capacity to allow efficient operation. The air reservoir 10 is operatively connected to the compressed air outlet 5 for receiving and storing compressed air. Output air line 12*a* is connected to the compressed air outlet 5 and conducts air to an unloading valve 13. Output air line 12*b* connects the unloader valve 13 to the air reservoir 10 via an air quick coupler 14. Check valve 15, located between the air quick coupler 14 and the air reservoir 10 is operative to allow compressed air to enter the air reservoir 10 and to prevent compressed air from leaving the air reservoir 10. Many conventional air-line quick couplers incorporate a check valve so that when disconnected, compressed air does not escape. The check valve 15 may also incorporate a dump valve that is commonly used in portable air compressor systems to release air when the check valve 15 closes so that the compressor is not starting against pressure.

Figure 2:
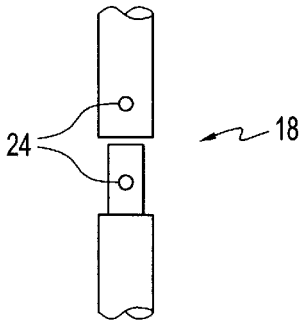
FIG. 2 is a side view of the releasable attachment of the air reservoir to the air compressor unit.

The air reservoir 10 is releasably attached to the compressor unit 16 via a sliding tube connection 18 to the frame 17 as illustrated in FIG. 2, which allows the air reservoir 10 to be lifted off the frame 17. The connection is maintained by a pin through mating holes 24 in the two parts of the connection. Many other releasable means are known in the art, and all such means are considered to fall within the scope of the present invention. The air quick coupler 14 then allows the air reservoir 10 to be removed and used as a portable air tank to carry compressed air to a remote location.

After the air compressor 4 has been operating for a time, the pressure in the air reservoir 10 and output air line 12*b* climbs to a maximum pressure at which point the unloading valve 13 opens and begins to exhaust compressed air dispensed from the compressed air outlet 5. As air is drawn from the air reservoir 10, the pressure in the air reservoir 10 and output air line 12*b* drops to a minimum pressure at which point the unloading valve 13 closes and ceases to exhaust compressed air so that the full output of the air compressor 4 is directed to the air reservoir 10. Thus the pressure in the air reservoir 10 varies within an operating range from the minimum to the maximum pressure. The operation of the unloading valve 13 greatly reduces the opening and closing of the mechanism. For instance a conventional pressure relief valve would open and close rapidly as compressed air was drawn from the air reservoir 10.

An air line 19 may be attached to the air reservoir 10 at air reservoir output 22 for supplying compressed air to a desired location. The attachment may be via a quick coupler or the line may simply be threaded into the air reservoir output 22.

In operation, to start the system, a control valve on the tractor is operated to start a flow of pressurized hydraulic fluid through the hoses 9 to the hydraulic motor 6, causing same to rotate and drive the air compressor 4. Compressed air at relatively low pressure starts to flow out the compressed air outlet 5, through the output air line 12*a*, the unloading valve 13, the output air line 12*b*, the air quick coupler 14, and the check valve 15 into the air reservoir 10. As the air reservoir 10 fills, the pressure rises until it attains the maximum pressure, at which time the unloading valve operates to exhaust compressed air. As compressed air is drawn from the air reservoir 10 by the air-line 19, the compressed air pressure starts to fall. When it falls to the minimum air pressure, the unloading valve closes and ceases to exhaust air so that the full output of the air compressor 4 is directed to the air reservoir 10. If the air reservoir 10 is disconnected at the air quick coupler 14, the hydraulic motor 6 and air compressor 4 continue to operate and the air pressure in the output air line 12*b* rises to the maximum, causing the unloading valve 13 to exhaust compressed air dispensed out of the compressed air outlet 5. When the air reservoir 10 is reconnected, air will flow into the air reservoir 10 provided the pressure therein is below the minimum, as it will be if the air reservoir 10 has been used. The air pressure falls to the minimum, causing the unloading valve 13 to close, directing air to the air reservoir 10 which will again be filled with compressed air until the maximum pressure is reached, causing the unloading valve 13 to exhaust. When operations are completed the control valve on the tractor 2 is operated to stop the flow of pressurized hydraulic fluid, and the hydraulic motor 6 stops. The hoses 9 may then be disconnected from the hydraulic outlets 3 and the whole system 1 carried away by the handle 23.

The unloading valve may operate in such a fashion that all compressed air from the compressed air outlet 5 is exhausted when the maximum pressure is reached, or such that air may flow through the exhaust and into the air reservoir 10 at the same time.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. A portable hydraulic powered high capacity air compressor system for use with a vehicle, said vehicle including a hydraulic power system for delivering pressurized hydraulic fluid to a hydraulically operated device, said air compressor system comprising:

an air compressor having a compressed air outlet for dispensing compressed air, said compressed air having an air pressure;

a hydraulic motor attached to said air compressor and operatively connected thereto for driving same, said air compressor and attached hydraulic motor forming a compressor unit;

means to temporarily connect said hydraulic motor to said hydraulic power system, on said vehicle for driving said hydraulic motor;

an air reservoir releasably attached via a sliding tube connection said compressor unit, and operatively connected to said compressed air outlet for receiving and storing compressed air, the operative connection allowing said air reservoir to be detached from said operative connection while said compressor unit is operating and while maintaining compressed air in said air reservoir;

an unloading valve operative to open and begin to exhaust compressed air dispensed from said compressed air outlet when said air pressure climbs to a maximum air pressure, and so as to close and cease to exhaust compressed air when said air pressure falls to a minimum air pressure as compressed air is drawn from the air reservoir such that the compressed air dispensed from said compressed air outlet is directed to the air reservoir; and means to operatively connect an air line to said air reservoir for supplying compressed air to a desired location.

2. The system of claim 1 wherein said means to temporarily connect said hydraulic motor comprises a plurality of hoses, each hose operatively connected at a motor end thereof to said hydraulic motor; and each hose comprising a quick coupler operatively connected at a free end thereof for connecting same to said hydraulic power system.

3. The system of claim 1 further comprising a flow control valve operable to provide a substantially constant volume of hydraulic fluid flow to said hydraulic motor as a pressure of said pressurized hydraulic fluid varies.

4. The system of claim 1 wherein said operative connection of said air reservoir to said compressed air outlet comprises a check valve operative to allow compressed air to enter said air reservoir and to prevent air from leaving said air reservoir.

* * * * *